US007309036B2

(12) United States Patent
Crossley et al.

(10) Patent No.: US 7,309,036 B2
(45) Date of Patent: Dec. 18, 2007

(54) REFINING MEMBER CLASH CONTROL METHOD

(75) Inventors: Bruce R. Crossley, Pittsfield, MA (US); Dwight Shelomis, Windsor, MA (US)

(73) Assignee: GL&V Management Hungary Kft, Luxembourg (LU)

( * ) Notice: Subject to any disclaimer, the term of this patent is extended or adjusted under 35 U.S.C. 154(b) by 0 days.

(21) Appl. No.: 11/293,963

(22) Filed: Dec. 5, 2005

(65) Prior Publication Data

US 2007/0125891 A1 Jun. 7, 2007

(51) Int. Cl.
*B02C 4/32* (2006.01)

(52) U.S. Cl. ..... 241/33; 241/261.2

(58) Field of Classification Search ..... 241/33, 241/37, 261.2, 261.3
See application file for complete search history.

(56) References Cited

U.S. PATENT DOCUMENTS

| | | | | |
|---|---|---|---|---|
| 3,893,631 | A * | 7/1975 | Fisher et al. | 241/37 |
| 4,233,600 | A * | 11/1980 | Rogers et al. | 340/683 |
| 4,627,578 | A | 12/1986 | Whyte | 241/30 |
| 6,840,470 | B2 | 1/2005 | Bankes et al. | 241/30 |

* cited by examiner

*Primary Examiner*—Faye Francis
(74) *Attorney, Agent, or Firm*—James Earl Lowe, Jr.

(57) ABSTRACT

A control system with a sensor mounted in direct mechanical connection to a non-rotating refining member so that the sensor is responsive to axial vibration movement of the support, and an analog to digital converter directly connected to the output of the sensor without filtering. The control system also includes a controller connected to the analog to digital converter and responsive to the analog to digital converter to compare the amplitude of the output signal from the sensor to a baseline value based on the level of vibration associated with the pulp refiner when it is operating without plate clashing. When the signal exceeds the baseline value, an action is taken to help alleviate the plate clashing.

6 Claims, 2 Drawing Sheets

REFINING MEMBER CLASH CONTROL METHOD

BACKGROUND OF THE INVENTION

The present invention relates to refiners for papermaking pulp or the like, and more particularly to improvements in refiners whose inlet admits stock for treatment by comminuting projections (e.g., ribs) on the neighboring surfaces of non-rotating refining members and rotary refining members.

The Pulp and Paper Industry uses pulp refiners to prepare papermaking fiber for production of paper products. The purpose of this refining process is to increase the strength potential of the pulp slurry before the pulp is formed into a sheet of paper. This is accomplished by passing the paper pulp between sets of refining members (also referred to as plates or discs) consisting of alternating bars and grooves that are in close proximity to each other. The gap between these plates is adjustable and can be as little as 2 thousandths of an inch. One of the plates rotates while the other plate in the set is stationary or non-rotating. The papermaking fiber is pumped through the refiner and passed between the refining members. The bar edges capture the papermaking fiber thus generating alternating compression and relaxation in the fiber.

The refining members are urged together by, for example, hydraulic piston and cylinder assemblies or by a motor that adjusts the position of one of the stationary plates. The close proximity of the rotating refining member to the non-rotating refining member under some circumstances can result in contact between the two plates. Also, since the plates are held apart only by the papermaking pulp passing between the plates, if the supply of pulp reduces or ceases, the plates can move into contact with each other. The plates coming together and making contact with each other is called "plate clashing". This condition, if allowed to continue for sustained periods of time, results in rapid wear of the refining member bars and poor fiber development and paper strength properties. It is desirable to be able to recognize this condition when it occurs and make adjustments to the process, if possible, to eliminate it.

It is already known to utilize in a rotor refiner two coaxial plates, at least one of which is driven by a discrete prime mover and which have neighboring surfaces provided with ribs or otherwise configured projections which comminute the material to be treated while the material advances from the inlet toward the outlet of the stock chamber. It is also known to dispose two rotary discs between two stationary discs so that each rotary disc cooperates with a different stationary disc.

As discussed in Whyte U.S. Pat. No. 4,627,578, there have been attempts to detect plate clashing using the techniques of measuring increased work, increased energy requirements, or bearing vibration resonances during clashing, and then backing off the plates. Whyte U.S. Pat. No. 4,627,578 disclosed an apparatus for controlling the relative position of refining members including vibration sensing means, such as a transducer fixed for example to one of the stationary plates. The transducer is preferably an accelerometer. According to this patent, the transducer is used to detect vibrations caused by passage of material between the refining members by detecting any decrease in vibrations from normal or safe operating conditions due to a reduced quantity of material passing between the refining members. A control means increases the distance between the refining members, when the decreased vibrations are sensed, in order to prevent clashing of the refining members.

SUMMARY OF THE INVENTION

The prior art approaches referred to above are not believed to be adequate for preventing all plate clashing, especially as can be experienced with low pulp consistency refiners. In low pulp consistency refiners, less pulp material flows through the refiner, which makes changes in refiner performance harder to detect.

One of the objects of the invention is to provide a refining member clash control method that sounds an alarm to alert operators that there is a need to take action, or that is programmed to take corrective action. The controller can then adjust the gap between the refining members or provides more flow to the refiner or some similar response that will result in separating the rotating and stationary elements of the plate that are in contact.

The invention is a control system that uses an electronic sensing device that is able to recognize the axial vibrations generated when a rotating refining member comes in contact with a stationary plate. The electronic sensing device provides a control signal to a refiner controller that either activates an alarm, automatically makes one or more desired process adjustments, or both.

The invention is based in part on the discovery of how the measurement of the axial vibration of a stationary disc refiner permits detection of plate clashing in a low pulp consistency refiner. Axial vibration is a velocity or acceleration change in the position of the stationary disc in a direction parallel to the axis of rotation of the rotating refiner member. Experimentation has determined that a sensor that only looks at radial vibration or a sensor location that is not directly mechanically connected to a stationary head fails to produce a detectable change in sensor output usable for indicating plate clashing is occurring. Such experimentation has also shown that the baseline level of these vibrations is about one half that of the sensor of this invention.

Another of the principal objects of the invention is to create a system that doesn't need to be tuned to a specific frequency. A further object is to create a system that can be used with different refining member patterns or refiner rotational speeds. And a further object of this invention is to create a system of relative simple design.

The invention comprises a method of responding to the beginning of plate clashing in a pulp refiner with a vibration sensor mounted in direct mechanical connection to the support of a non-rotating refiner member so that the sensor is responsive to axial vibration movement of the support. The method comprises comparing the amplitude of the output signal from the sensor to a baseline value based on the level of vibration associated with the pulp refiner when it is operating without plate clashing, and when the signal exceeds the baseline value, then taking an action intended to help alleviate the plate clashing. Such action can be sounding an alarm, changing the refining process, or both.

The invention also comprises a method and a control system for a refiner for pulp or like materials, the control system comprising a sensor mounted in direct mechanical connection to a non-rotating refining member so that the sensor is responsive to axial vibration movement of the support, and an analog to digital converter connected to the output of the sensor. The method and controller also include a controller connected to the analog to digital converter and responsive to the output from the analog to digital converter to compare the amplitude of the output signal from the sensor to a baseline value based on the level of vibration associated with the pulp refiner when it is operating without plate clashing. When the signal exceeds the baseline value, an action is taken to help alleviate the plate clashing.

This invention is thus relative simple in construction for it can be easily connected to the refiner stationary supports and connected to a conventional refiner Programmable Logic Controller (PLC).

Figure 1:
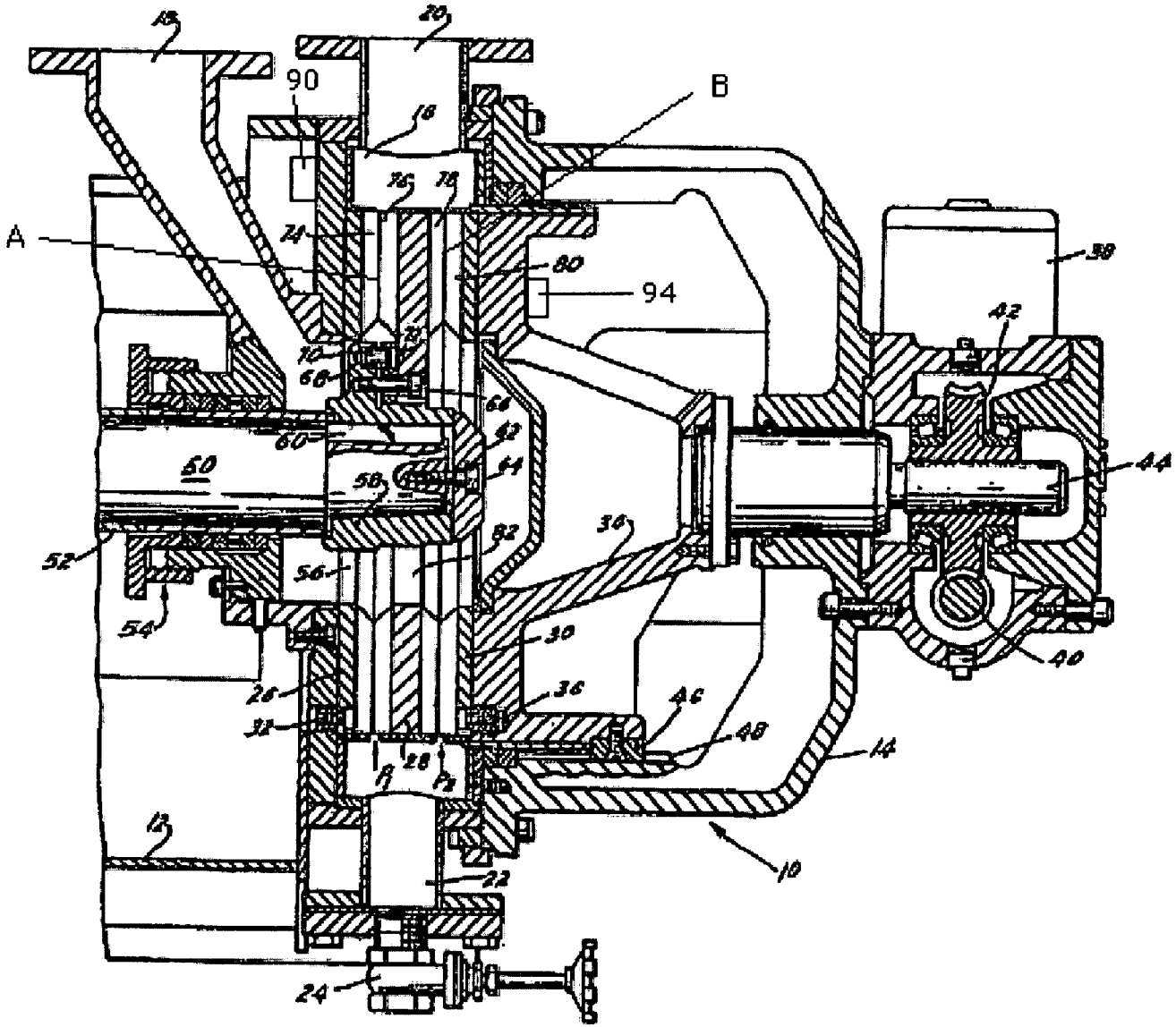
FIG. 1 is a fragmentary longitudinal vertical sectional view of a refiner according to this invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

Referring first to FIG. 1, there is shown a refiner having a housing 10 including several bolted-together sections, two of which are shown at 12 and 14. The housing defines a stock chamber 16 and has an inlet 18 for admission of pulp, e.g., from the outlet of a pump (not shown) or an inlet valve 39 (shown schematically in FIG. 2), a first outlet 20 for evacuation of refined pulp, at least in part under the action of centrifugal force, and a second outlet 22 that is normally closed by a suitable valve 24. The outlet 20 extends upwardly and the outlet 22 extends downwardly. The valve 24 is opened when the attendants wish to drain the liquid carrier for large pulp pieces or the like from the chamber 16.

The chamber 16 accommodates three refining members 26, 28, 30, here shown as coaxial discs having identical outer diameters. In other embodiments (not shown), only two discs can be used, or two back-to-back discs can be used instead of the single disc 28. In still other embodiments (not shown), additional disc sets can be used. In still other embodiments (not shown), the refining members may constitute cones or other types of refining members.

The disc 26 is stationary and is fixedly secured to the housing section 12 by screws 32 or analogous fasteners. The disc 30 does not rotate, is spaced apart from the disc 26, and is secured to an axially movable support 34 by means of screws 36 or the like. The support 34 is mounted in the housing section 14 and is movable axially of the discs 26, 28 by a reversible electric motor 38 which can drive a worm 40. The latter meshes with a worm wheel 42 having internal threads in mesh with external threads at the right-hand end of a spindle 44 which is rigid with the support 34. The support 34 has one or more radial projections or followers 46 slidable in elongated grooves 48 of the housing section 14. The grooves 48 are parallel to the common axis of the discs 26, 28 and 30. In other embodiments, other mechanisms for supporting the disc 30 can be used.

The disc 28 is rotatable relative to and is movable axially between the discs 26 and 30. The means for rotating the disc 28 comprises a drive shaft 50 that rotates in a sleeve 52 mounted in the housing section 12. The sleeve 52 is surrounded by a stuffing box 54 that prevents the escape of pulp from the chamber 16 into the left-hand portion of the housing section 12. That end portion of the shaft 50 that extends from the housing section 12 preferably carries a pulley or sprocket wheel driven by an electric motor or another suitable prime mover through the medium of an endless belt or chain. Other types of transmissions between the prime mover and the shaft 50 can be used with equal advantage.

The disc 26 has a relatively large central opening 56 that communicates with the inlet 18 and surrounds the shaft 50 with a substantial amount of clearance. That end portion of the shaft 50 which extends beyond the opening 56 and into the central part of the chamber 16 carries a hub 58 which is secured thereto by a key 60, a cap 62 and a screw 64 so that the hub 58 shares all angular movements of the shaft 50. The hub 58 transmits torque to the centrally located disc 28 by way of several screws 66 but the disc 28 has limited freedom of axial movement relative to the hubs 58 and screws 66. The hub is provided with an eccentric blind bore 68 for a guide pin 70 a portion of which extends into an aligned blind bore 72 of the disc 28. It can be said that the disc 28 "floats" between the discs 26, 30 and automatically finds a central position between the stationary discs 26, 30, not only in response to wear on the surfaces of comminuting projections on the discs but also upon axial adjustment of the disc 30.

The discs 26, 28 and 28, 30 respectively define first and second paths A and B along which the pulp can advance from the inlet 18 toward the first outlet 20 (the second outlet 22 is assumed to be sealed when the refiner is in use). The path A is flanked by rib-shaped comminuting projections 74, 76 of the discs 26, 28, and the path B is flanked by rib-shaped comminuting projections 78, 80 of the discs 28, 30. The opening 56 of the disc 26 admits pulp from the inlet 18 into the central portion of the first path A, and such pulp flows radially outwardly between the projections 74, 76 toward the outlet 20.

THE PLATE CLASH CONTROL SYSTEM AND METHOD OF THE INVENTION

The specific embodiment of the invention is designed for use on many configurations of refining equipment. The working elements of the control system 100 of this invention comprise an accelerometer or similar vibration-sensing device or sensor 90 that is mechanically directly connected to the plate-mounting housing section 12 by means such as screws (not shown). Although in this embodiment the sensor 90 is mounted on the housing section 12 on the side opposite the stationary refining member or disc 26, in other embodiments (not shown), the sensor 90 can be mounted on the same side of the housing section 12 as the stationary refining member 26, or otherwise in direct mechanical connection with the stationary refining member 26. In the preferred embodiment, a second sensor 94 identical to the first sensor 90 is mounted on the second non-rotating but axially movable support 34. When a second sensor 94 is used, its output is also checked as outlined below so that if it senses plate clashing so a responsive action can be taken. In other embodiments (not shown), just one of either of the two sensors 90 and 94 can be used. In still other embodiments (not shown), the two sensors 90 and 94 can have different operating characteristics.

The sensor 90 is capable of measuring vibration across a range from 1 HZ to 10 kHZ. Thus the sensor 90 doesn't need to be tuned to a specific frequency that changes for different refining member patterns or refiner rotational speeds.

Any refiner will have some pattern of and level of vibration associated with it when it is running normally. This becomes the baseline vibration level. When plate clash occurs or starts to occur that level increases and increases gradually as the intensity of the clash increases. A vibration level amplitude slightly above the baseline value is selected as the threshold for the alarm or control to take action. The selected sensor 90 measures acceleration, but in other embodiments (not shown), a sensor that measures velocity can also be used.

Figure 2:
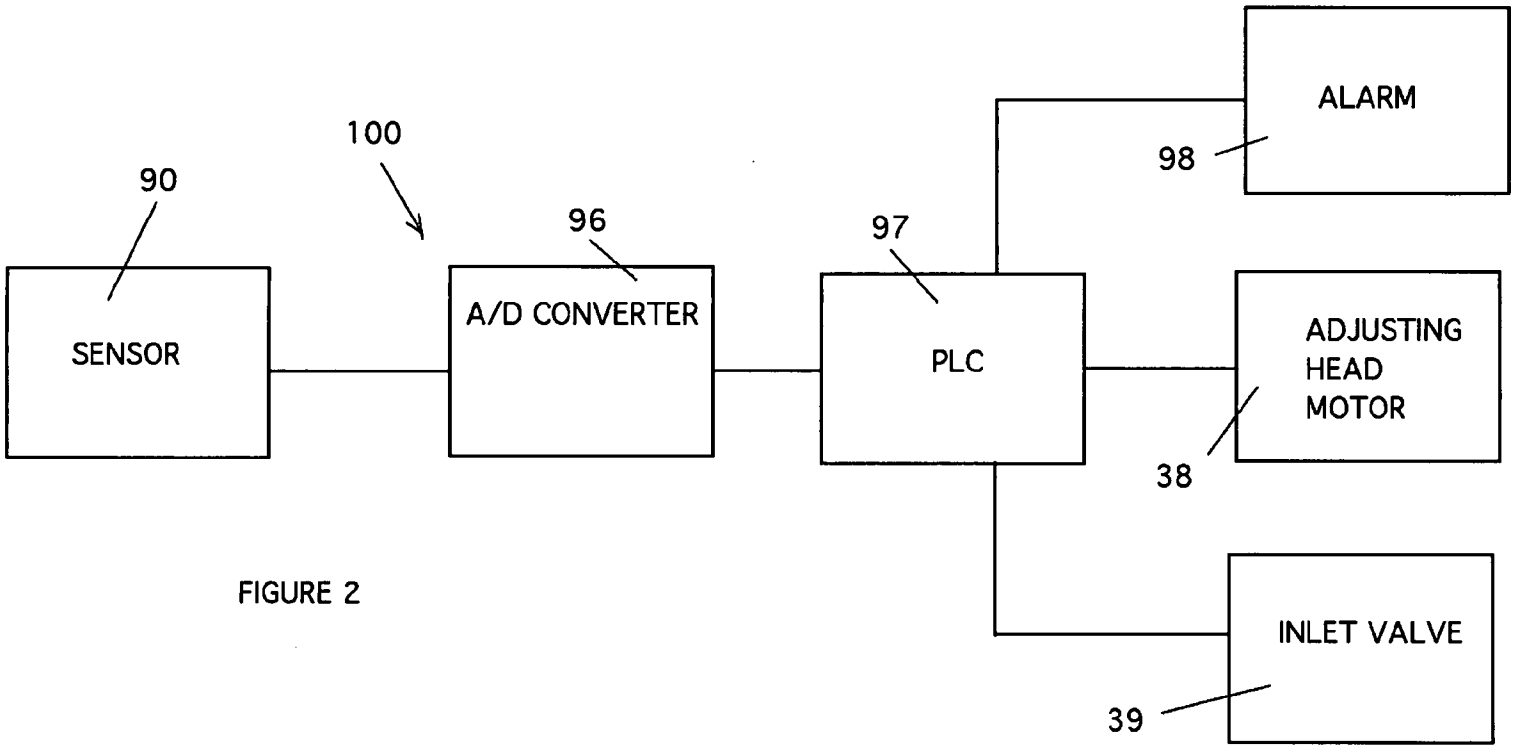
FIG. 2 is a schematic diagram of the control scheme of this invention.

The sensor 90 senses the vibration generated by the physical contact of the rotating portion of the refining member 28 with the fixed portion of the plate 26 and converts that vibration into electrical impulses. Those electrical impulses are sent directly, without filtering, to an analog to digital converter 96 (see FIG. 2) that is capable of converting the sensor's electronic signal into that which can be used by a computer-based (PLC based) controller 97. The controller 97 is programmed to respond to a specific amplitude of vibration that is associated with plate clash or plate contact. In one embodiment, the response generated by the controller sounds an alarm 98 to alert operators that there is a need to take action. In this embodiment, the controller 97 is also programmed to take corrective action. As illustrated in FIG. 2, the controller 97 adjusts the gap between the refining members by operating the adjusting head motor 38 to move the plate 30 away from the plate 26, or provides more flow to the refiner by opening the inlet valve 39 or some similar response that would result in separating the rotating and stationary elements of the plates that are in contact. The signal cables that connect these various elements can then be either brought to the refiner controller 97 directly or to an electrical junction box and wired from there to the controller 97 if it is remote from the refiner location.

In other words, the control system 100 of this invention responds to the beginning of plate clashing in a pulp refiner with the vibration sensor 90 mounted in direct mechanical connection to the support 12 of the non-rotating refining member 26 so that the sensor 90 is responsive to axial vibration movement of the support 12, the control system 100 comparing the amplitude of the output signal from the sensor 90 to a baseline value based on the level of vibration associated with the pulp refiner when it is operating without plate clashing, and when the signal exceeds the baseline value, then taking an action intended to help alleviate the plate clashing.

Figure 3:
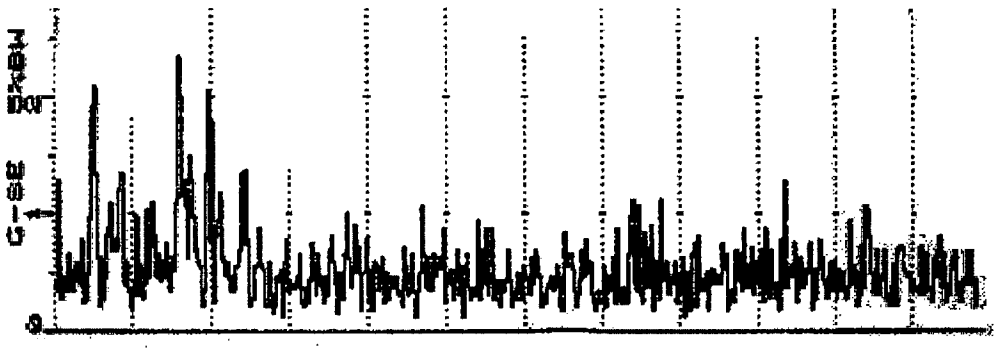
FIG. 3 is a reproduction of a plot of the output of a sensor attached to and responsive to axial movement of one of the supports of a non-rotating refining member. The plot illustrates where plate clashing begins, and how operations return to normal after pulp flow is either increased or when the refining members are moved further apart. The vertical axis is acceleration, measured in multiples of G force, and the horizontal axis is time.

Differences between background vibration slight plate clash and significant plate clash are able to be distinguished. As shown in FIG. 3, with a baseline value set at 1.5 G's, the plate clashing occurring at the beginning of this plot can be detected and acted upon.

The type of corrective response is determined on the specific demands of the system in which the refiner is installed and operating.

Various other features and advantages of the invention will be apparent from the following claims.

The invention claimed is:

1. A control system for a refiner, the refiner comprising a housing having a chamber, a support in said chamber, a material-admitting inlet and an outlet; a nonrotating refining member mounted on said support, and a rotary refining member disposed in said chamber adjacent said non-rotating refining member and defining there between a path for the movement of material from said inlet to said outlet, said rotary refining member and said non-rotating refining member being coaxial with each other, the control system comprising a sensor mounted in direct mechanical connection to the non-rotating refining member so that said sensor is responsive to axial vibration movement of said support, an analog to digital converter directly connected without filtering without filtering to the output of said sensor, and a controller connected to said analog to digital converter and responsive to said analog to digital converter to compare the amplitude of the output signal from the sensor to a baseline value based on the level of vibration associated with the pulp refiner when it is operating without plate clashing, and when the signal exceeds the baseline value, take an action intended to help alleviate the plate clashing.

2. A refiner in accordance with claim 1 wherein said sensor is capable of measuring vibration across a range from 1 HZ to 10kHZ.

3. A refiner in accordance with claim 1 wherein said housing further includes a second support mounted in said housing with a second non-rotating refining member mounted on said second support, with said rotary refining member being located between said non-rotating refining members, and wherein said refiner further includes a second sensor mounted in direct mechanical connection to said second non-rotating refining member support so that said sensor is responsive to axial vibration movement of said second support.

4. A control system in accordance with claim 1 wherein said action is sounding an alarm.

5. A control system in accordance with claim 1 wherein said action is increasing the rate of flow of pulp into said refiner.

6. A control system in accordance with claim 1 wherein said action is increasing the spacing between said non-rotating and the rotary refining members.

* * * * *